US005676407A

United States Patent [19]

Smallegan et al.

[11] Patent Number: 5,676,407

[45] Date of Patent: Oct. 14, 1997

[54] DEAD BOLT ACTUATING ASSEMBLY

[75] Inventors: Jon M. Smallegan; L. C. Derek Chamberlain; Dario L. Pompeii, all of Colorado Springs, Colo.

[73] Assignee: Schlage Lock Company, San Francisco, Calif.

[21] Appl. No.: 656,736

[22] Filed: Jun. 3, 1996

[51] Int. Cl.[6] ..... E05C 1/06

[52] U.S. Cl. ..... 292/139; 292/36

[58] Field of Search ..... 292/169.13, 139, 292/140, 34, 36, 37; 70/107

[56] References Cited

U.S. PATENT DOCUMENTS

| | | | |
|---|---|---|---|
| 2,447,190 | 8/1948 | Lickteig | 292/169 X |
| 2,494,478 | 1/1950 | Kuzma | 292/165 |
| 3,036,850 | 5/1962 | Schmid | 292/167 X |
| 3,073,143 | 1/1963 | Eads | 292/169.14 X |
| 3,159,993 | 12/1964 | Crepinsek | 292/169.13 X |
| 3,175,376 | 3/1965 | Cantwell | 292/165 X |
| 3,912,309 | 10/1975 | Fischer et al. | 292/169.13 X |
| 3,933,016 | 1/1976 | Nolin | 292/165 X |
| 3,933,380 | 1/1976 | Wellekens | 292/175 |
| 4,031,725 | 6/1977 | Reid | 70/107 |
| 4,081,980 | 4/1978 | Hightower | 292/140 X |
| 4,248,452 | 2/1981 | Allenbaugh | 292/167 |
| 4,268,075 | 5/1981 | Allenbaugh | 292/1.5 X |
| 4,333,324 | 6/1982 | Dietrich et al. | 70/107 |
| 4,422,677 | 12/1983 | Gater | 292/167 X |
| 4,566,725 | 1/1986 | Klein | 292/191 |
| 4,656,849 | 4/1987 | Rotondi et al. | 292/1.5 X |
| 4,945,737 | 8/1990 | Hart | 70/143 |
| 5,058,940 | 10/1991 | Hart | 292/167 |
| 5,219,385 | 6/1993 | Yeh | 292/169.14 X |
| 5,452,928 | 9/1995 | Donald | 292/169.13 X |

FOREIGN PATENT DOCUMENTS

| | | | |
|---|---|---|---|
| 541605 | 1/1932 | Germany | 292/169.13 |

*Primary Examiner*—Rodney M. Lindsey

*Attorney, Agent, or Firm*—Robert F. Palermo; Michael H. Minns

[57] ABSTRACT

A dead bolt actuating assembly capable of moving a dead bolt between a retracted position and an extended position includes a latch arm having an end portion mounted on a rotating shaft. The latch arm is movable in response to the rotational movement of the shaft between a first position in which the dead bolt is in its retracted position and a second position in which the dead bolt is in its extended position. A link having an elongate body is pivotally connected to the opposite end portion of the latch arm at one end thereof. The link has a foot portion at the other end of the body extending in a generally perpendicular direction from the body. The foot portion is releasably engageable with the dead bolt for selectively moving the dead bolt from its retracted position to its extended position upon movement of the latch arm from its first position to its second position.

6 Claims, 3 Drawing Sheets

DEAD BOLT ACTUATING ASSEMBLY

BACKGROUND OF THE INVENTION

This invention generally relates to door hardware and more particularly to a dead bolt actuating assembly capable of moving a dead bolt between a retracted position and an extended position.

Current usage in commercial and retail cylindrical and tubular locks provide a dead latch along with the traditional spring latch for security. The degree of security provided by the dead latch is limited by the length of engagement of the dead latch bolt in the lock (normally one-half of an inch) and the necessity of having a dead bolt latching mechanism to prevent the spring latch from being manipulated back into the door preparation since the spring latch is spring loaded in the open position to allow the door to latch automatically. This dead bolt latching mechanism prevents the spring latch from being manipulated when the door is closed. In most instances where additional security is required an additional dead bolt lock is added to provide another bolt which cannot be manipulated and which projects further into the jam to take impact blows and provide resistance to "jam spreading" due to the additional length. This secondary auxiliary lock has a separate locking cylinder which is usually better protected than the cylinder in the cylindrical or tubular lock. The reason for this is because these cylinders are often in the knob or lever and are therefore subject to tampering.

The secondary auxiliary lock requires a separate door preparation for installation. In some instances, building codes require a panic proof connection mechanism be provided between the two locks to allow egress in the event of an emergency. This connection is also susceptible to manipulation and must also be protected for security in addition to the increased installation accuracy. Moreover, both the secondary lock and its installation result in added expense. The user also has the inconvenience of having to operate two separate locks in order to lock and open the door.

The foregoing illustrates limitations known to exist in present dead bolt actuating assemblies. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a dead bolt actuating assembly capable of moving a dead bolt between a retracted position and an extended position. The assembly is responsive to the rotational movement of a shaft for moving the dead bolt between its retracted and extended positions. The actuating assembly comprises a latch arm having a first end portion mounted on the shaft and a second end portion opposite the first end portion. The latch arm is movable in response to the rotational movement of the shaft between a first position in which the dead bolt is in its retracted position and a second position in which the dead bolt is in its extended position. A link having an elongate body is pivotally connected to the second end portion of the latch arm at one end thereof. The link has a foot portion at the other end of the body extending in a generally perpendicular direction from the body. The foot portion is releasably engageable with the dead bolt for selectively moving the dead bolt from its retracted position to its extended position upon movement of the latch arm from its first position to its second position.

Accordingly, among the several objects of the present invention are the provision of an improved dead bolt actuating assembly which is capable of moving a dead bolt of the assembly between an extended position and a retracted position independent of the actuation of the spring latch of the door lock; the provision of such an improved actuating assembly which extends the dead bolt further into the door preparation than prior art dead bolt latches; the provision of such an actuating assembly having relatively few component parts; the provision of such an actuating assembly which incorporates the dead bolt preparation into the construction of the spring latch mechanism; the provision of such an actuating assembly which is less expensive than prior art dead bolt actuating assemblies; and the provision of such an actuating assembly which is simple in design and easy to install.

The foregoing and other aspects will become apparent from the following detailed description of the invention when considered in conjunction with the accompanying drawing figures.

BRIEF DESCRIPTION OF THE DRAWING FIGURES

In the drawings which illustrate the best mode presently contemplated for carrying out the present invention:

Corresponding reference numerals designate corresponding parts throughout the several views of the drawings.

DETAILED DESCRIPTION

Figure 1:
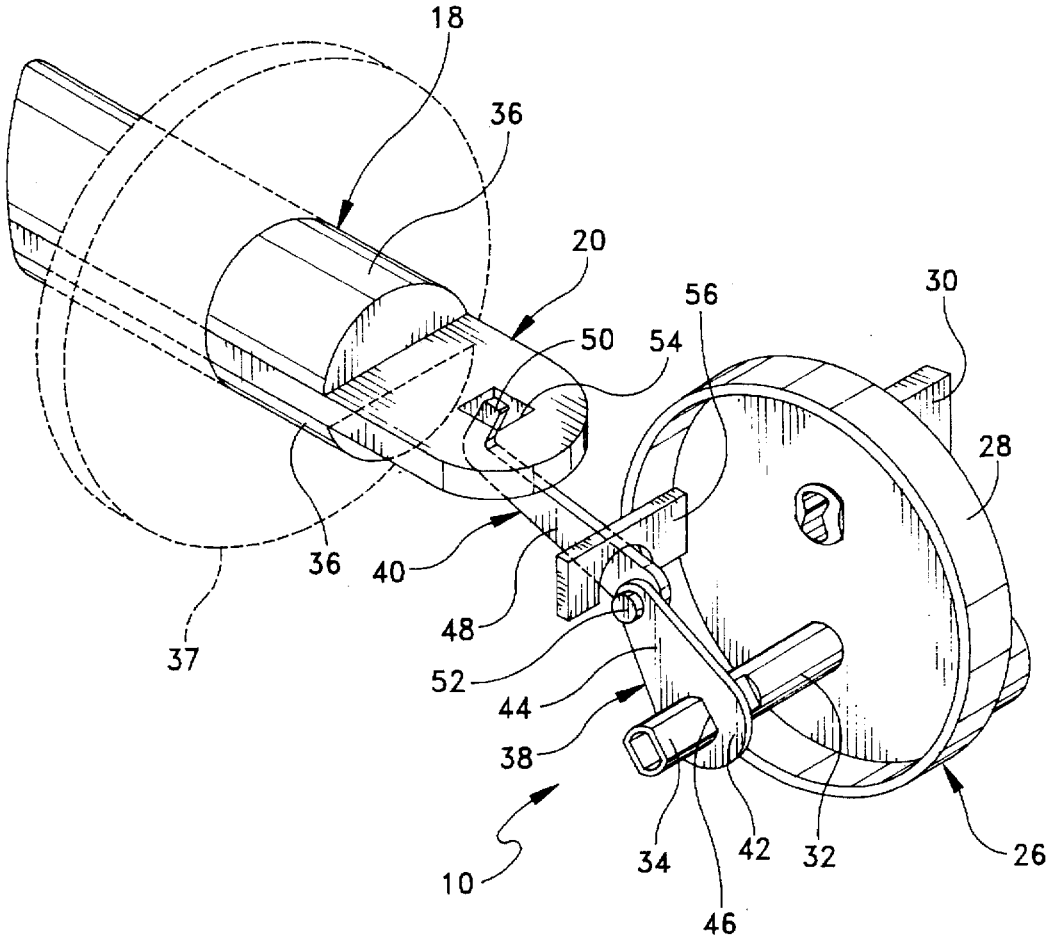
FIG. 1 is a perspective view of a dead bolt actuating assembly of the present invention installed in a standard door preparation.
Figure 2:
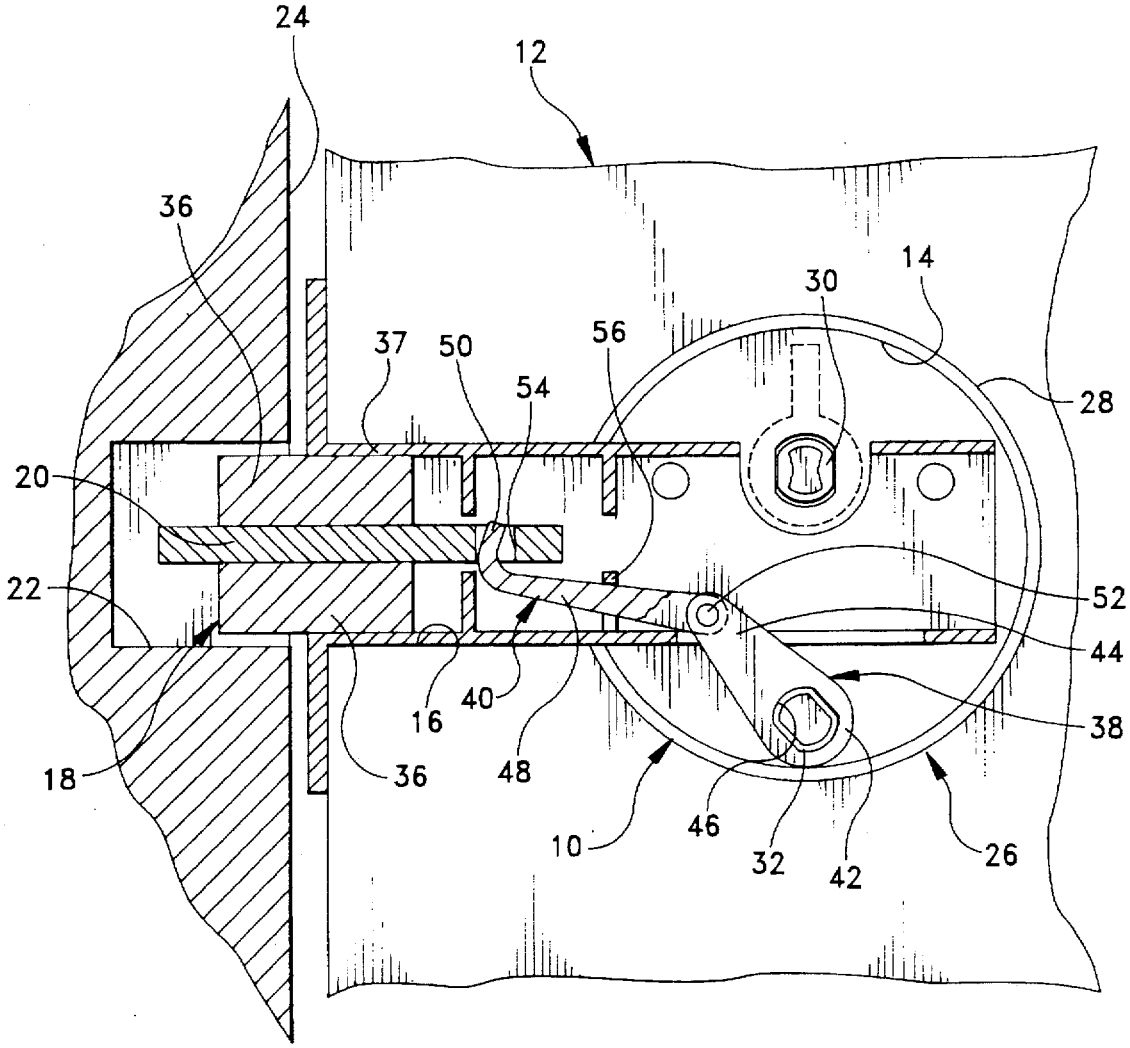
FIG. 2 is a partial cross-sectional view of the actuating assembly in a position in which a link of the assembly is engaging a dead bolt for moving the dead bolt between an extended (locking) position and a retracted position.
Figure 3:
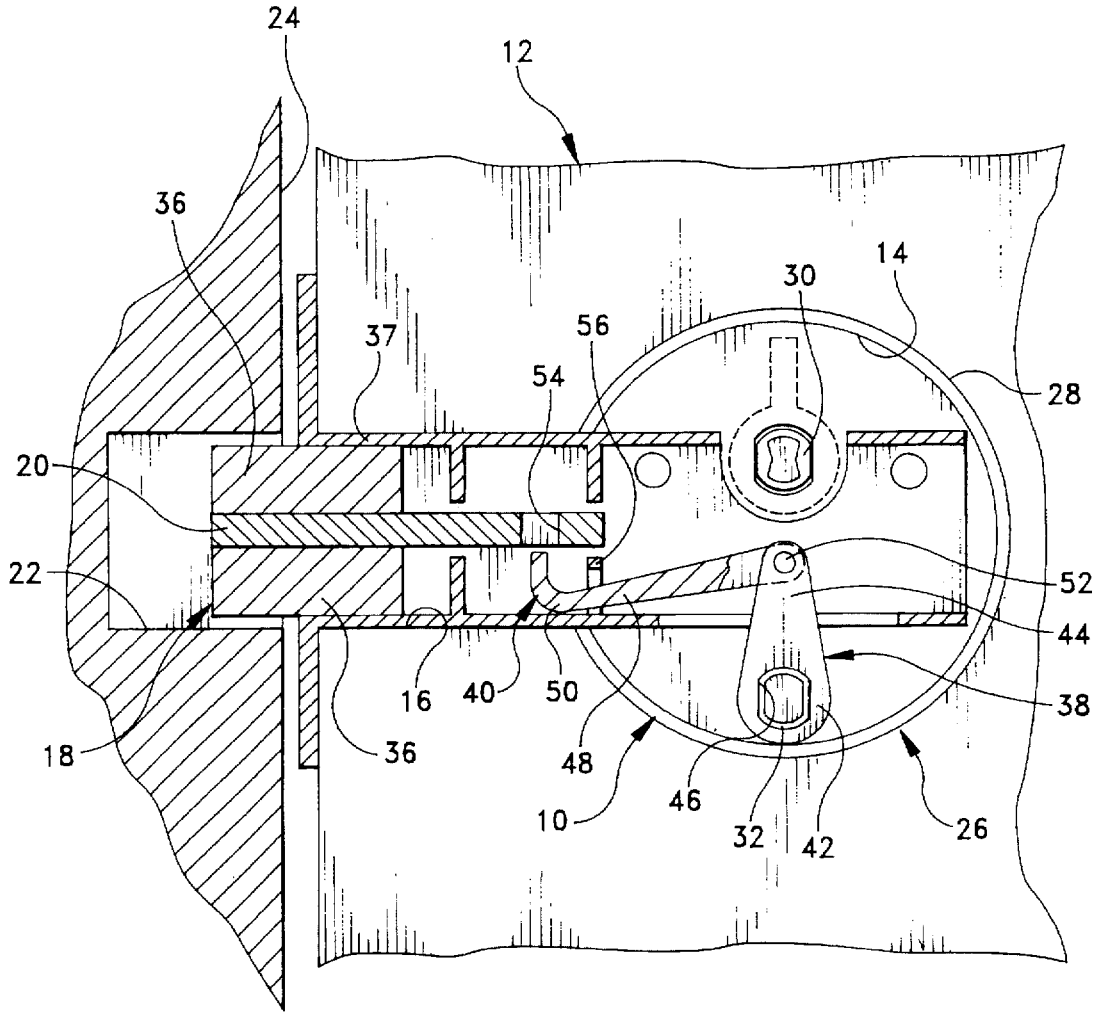
FIG. 3 is a partial cross-sectional view similar to FIG. 2 illustrating the link disengaged from the dead bolt.

Referring now to the drawings, wherein similar reference characters designate corresponding parts throughout the several views, the embodiment of the apparatus shown in drawings comprises a dead bolt actuating assembly which is generally indicated 10. As shown in FIGS. 2 and 3, the actuating assembly 10 is of the type installed in a door, generally indicated at 12, having a traditional door preparation, i.e., a preparation having a 2⅛ inch diameter bore 14 formed in the door 12 adjacent its edge between its planar surfaces and a smaller ⅞ inch diameter bore 16 formed in the edge of the door 12 such that it extends in a direction perpendicular to and communicates with the 2⅛ inch diameter bore. Such a door preparation comes standard on commercial and retail doors.

Traditionally, if a purchaser of such a door 12 desired to install a dead bolt, he or she would have one of two choices. The first choice is to install a spring latch assembly having a dead bolt latch which only extends within an opening in the opposite facing door jamb approximately one half an inch. This choice suffers from the disadvantage that the dead bolt extends within the door jamb a short distance thereby making it easy to manipulate the mechanism or open the door by force ("jamb spreading"). The second choice is to install a separate door preparation for receiving a separate dead bolt assembly. However, this alternative is very costly.

The dead bolt actuating assembly 10 of the present invention operates in concert with a spring latch mechanism, generally indicated at 18, for extending a dead bolt, generally indicated at 20, within a bore 22 formed in a door jamb 24 which is co-axial with bore 16. The actuating assembly 10 operates along with a door latch operating assembly generally designated 26 having a lock platform 28 which houses an operating handle (not shown) and a thumb turn member 30. A detailed description of the door latch operating assembly 26 and its operation is provided in co-pending, related application entitled Door Latch Operating Assembly, Ser. No. 08/364,645 now U.S. Pat. No. 5,492,380, of which Jon M. Smallegan, L. C. Derek Chamberlain and Dario Pompeii are co-inventors. As shown, the thumb turn member 30 rotates a shaft 32 of the assembly 26 about an axis A, the shaft 32 having a generally rectangular-shaped outer end 34. The shaft 32 can also be rotated by the door handle as disclosed in the aforementioned application. This shaft 32 is interconnected with the actuating assembly 10 of the present invention for moving the dead bolt 20 between its extended position in which it extends into the bore 22 of the door jamb 24 and locks the door 12, and a retracted position in which it withdraws out of the bore 22 of the door jamb 24 and enables the door 12 to be opened.

Turning to FIGS. 2 and 3, the spring latch mechanism 18 is of the type having a pair of spring acting members each indicated at 36 which are normally biased outwardly by a spring (not shown). As shown, the members are located within a housing 37 wherein one member 36 is positioned above the dead bolt 20 and the other member 36 is positioned below the dead bolt 20. Each member 36 has an angled face which engages the door jamb 24 for spring acting the members 36 against the bias of the spring until the door completely closes whereby the members 36 extend back into the door jamb bore 22. Such an arrangement is well-known in the art of door hardware and to those skilled in the art.

The actuating assembly 10 comprises a latch arm, generally indicated at 38, and a generally tear-drop-shaped link, generally indicated at 40, which is pivotally connected to the latch arm 38. More specifically, the latch arm 38 has a first end portion 42 which is mounted on the shaft 32 and a second end portion 44 opposite the first end portion 42. The first end portion 42 has an opening 46 formed therein which is sized to receive the shaft 32 of the door latch operating assembly 26 therethrough. The arrangement is such that when the shaft 32 rotates about its axis A, the link 40 is pivoted about the axis A. The latch arm 38 is movable in response to the rotational movement of the shaft 32 between a first position (FIG. 3) in which the dead bolt 20 is in its retracted position and a second position (FIG. 2) in which the dead bolt 20 is in its extended position. The link 40 has an elongate body 48 which is pivotally connected to the second end portion 44 of the latch arm 38 at one end thereof, and a foot portion 50 at the other end of the body 48 extending in a generally perpendicular direction from the body 48. As shown, a pin 52 connects the link body 48 to the second end portion 44 of the latch arm 38. The foot portion 50 is releasably engageable with the dead bolt 20 for selectively moving the dead bolt 20 from its retracted position to its extended position upon movement of the latch arm 38 from its first position to its second position, respectively.

Turning to FIG. 2, the dead bolt 20 has an opening 54 formed therein which is sized for receiving the foot portion 50 of the link 40 therethrough. The foot portion 50, when the latch arm 38 is in its second position, extends through the opening 54 of the dead bolt 20 thereby engaging the dead bolt 20 and maintaining the dead bolt 20 in its extended position. Any attempt to move the dead bolt 20 back to its retracted position is resisted by the link 40. Turning to FIG. 3, upon pivoting the latch arm 38 to its first position, the foot portion 50 of the link 40 engages the dead bolt 20 and draws it back to its retracted position. The link 40 is engaged by a link engaging member 56 mounted on the lock platform 28 as the foot portion 50 of the link 40 is being withdrawn from the opening of the dead bolt 20. The arrangement is such that as the latch arm 38 moves from its second position to its first position the link engaging member 56 engages the link 40 so as to move the foot portion 50 of the link 40 out of the opening 54 of the dead bolt 20.

Preferably, the dead bolt 20 also has an angled face and is spring biased outwardly when it is in its retracted position so that it moves with the spring latch 18 when closing the door 12. The spring biasing of the dead bolt 20 when it is disengaged from the link 40 can be accomplished by any suitable means.

The operation of the dead bolt actuating assembly 10 is as follows. FIG. 3 illustrates the dead bolt 20 in its retracted position wherein the latch arm 38 is in its first position. When the door 12 is closed, the latch arm 38 can be rotated counterclockwise to its second position (which is illustrated in FIG. 2), wherein the foot portion 50 of the link 40 enters the opening 54 of the dead bolt 20 and engages the dead bolt 20 for moving it to its extended position. In this position, the dead bolt 20 enters the bore 22 formed in the door jamb 24 for locking the door 12 in its closed position. The dead bolt 20 is retracted by rotating the latch arm 38 clockwise back to its first position. The foot portion 50 of the link 40 engages the dead bolt 20 for drawing the dead bolt 20 out of the bore 22 of the jamb 24. The engaging member 56 engages the link 40 for moving it downwardly so that the foot portion 50 of the link 40 is withdrawn from the opening 54 of the dead bolt 20 thus disengaging the link 40 from the dead bolt 20. The spring action of the dead bolt 20 enables it to move with the spring latch 18, for example, when turning the handle of the door 12 for opening the door.

It should be observed that the dead bolt actuating assembly 10 of the present invention is capable of moving the dead bolt 20 further into the door preparation than prior art dead bolt latches (e.g., approximately one inch) since the assembly 10 operates under a completely separate system than the spring latch 18. Since the actuating assembly 10 has relatively few component parts, it is less expensive than prior art dead bolt actuating assemblies.

While this invention has been illustrated and described in accordance with a preferred embodiment, it is recognized that variations and changes may be made therein without departing from the invention as set forth in the following claims.

Having described the invention, what is claimed is:

1. The combination comprising a shaft, a dead bolt and a dead bolt actuating assembly responsive to rotational movement of the shaft for moving said dead bolt between a retracted position and an extended position, said actuating assembly comprising:

a latch arm having a first end portion mounted on said shaft and a second end portion opposite the first end portion, said latch arm being movable in response to rotational movement of the shaft between a first position in which the dead bolt is in its retracted position and a second position in which the dead bolt is in its extended position;

a link having an elongate body pivotally connected at one end thereof to the second end portion of the latch arm, and a foot portion at a second end of the body extending in a generally perpendicular direction from said body, said foot portion being releasably engageable with said dead bolt for selectively moving the dead bolt from its retracted position to its extended position upon movement of the latch arm from its first position to its second position; and, a link engaging member engaging said link to disengage said foot from said dead bolt as the latch arm moves from said second position to said first position.

2. The combination as set forth in claim 1, said link being connected to the second end portion of the latch arm by a pin.

3. The combination as set forth in claim 1, said dead bolt having an opening formed therein wherein said foot portion of the link is receivable in the opening of the dead bolt when moving the dead bolt from its retracted position to its extended position.

4. The combination comprising a dead bolt, a shaft and a dead bolt actuating assembly responsive to rotation of said shaft for moving said dead bolt between a retracted position and an extended position, said dead bolt having an opening therein, said actuating assembly comprising:

a latch arm having a first end portion mounted on said shaft, said latch arm being movable in response to rotation of said shaft between a first position in which the dead bolt is in said retracted position and a second position in which the dead bolt is in said extended position;

a link having an elongate body pivotally connected at one end thereof to a second end portion of the latch arm, said link having a second end with a foot portion extending generally perpendicular to the elongate body, said foot portion being selectively engageable with said dead bolt in said opening to selectively move the dead bolt between said retracted position and said extended position, and a link engaging means for engaging said link to cam said foot out of said opening as the dead bolt moves toward the retracted position.

5. The combination as claimed in claim 4 wherein, as said shaft is rotated in a first direction said foot engages a first wall portion bounding said opening to pull said dead bolt toward said retracted position.

6. The combination as claimed in claim 5 wherein, as said shaft is rotated in a second direction, opposite to said first direction, said foot engages a second wall portion bounding said opening to push said dead bolt toward said extended position.

* * * * *